US006210010B1

(12) United States Patent
Pontetti et al.

(10) Patent No.: US 6,210,010 B1
(45) Date of Patent: Apr. 3, 2001

(54) ILLUMINATED PUSHBUTTON WITH COLORS AND BRIGHTNESS ELECTRONICALLY CONTROLLED

(75) Inventors: Antonio Pontetti; Giorgia Pontetti, both of Rieti (IT)

(73) Assignee: G. & A. Engineering S.R.L., Carsoli (IT)

( * ) Notice: Subject to any disclaimer, the term of this patent is extended or adjusted under 35 U.S.C. 154(b) by 0 days.

(21) Appl. No.: 09/296,518

(22) Filed: Apr. 22, 1999

(30) Foreign Application Priority Data

Nov. 27, 1998 (IL) ..... RM98A0727

(51) Int. Cl.[7] ..... H01H 13/70

(52) U.S. Cl. ..... 362/24; 362/29; 362/30; 362/85; 362/230; 362/231; 200/314; 200/315; 200/313; 200/317; 200/311; 200/341; 200/345; 200/303; 200/293; 200/310; 200/307

(58) Field of Search ..... 200/314, 313, 200/317, 311, 341, 345, 303, 293, 310, 307; 362/24, 29, 30, 85, 230, 231

(56) References Cited

U.S. PATENT DOCUMENTS

| | | | | |
|---|---|---|---|---|
| 5,122,626 | * | 6/1992 | Shinohara et al. | 200/457 |
| 5,165,530 | * | 11/1992 | Shinohara et al. | 200/314 |
| 5,651,450 | * | 7/1997 | Priesemuth | 200/314 |
| 5,655,826 | * | 8/1997 | Kuono | 362/24 |
| 5,941,372 | * | 8/1999 | Johnston | 200/343 |
| 5,962,971 | * | 10/1999 | Chen | 362/800 |
| 5,990,435 | * | 11/1999 | Chao | 200/517 |
| 6,036,326 | * | 3/2000 | Yoshikawa | 362/23 |
| 6,060,672 | * | 5/2000 | Sugihara | 200/345 |

* cited by examiner

*Primary Examiner*—Sandra O'Shea
*Assistant Examiner*—Anabel M Ton
(74) *Attorney, Agent, or Firm*—Herbert Dubno

(57) ABSTRACT

An illuminated pushbutton has a display assembly which is movable relative to a fixed part containing a switch assembly. The display assembly contains a plurality of solid state light generating devices which can individually or in combination provide illumination with variable coloring characteristics. A flexible circuit element connects these devices to electronic circuitry in the fixed part which controls the coloration of the display.

7 Claims, 7 Drawing Sheets

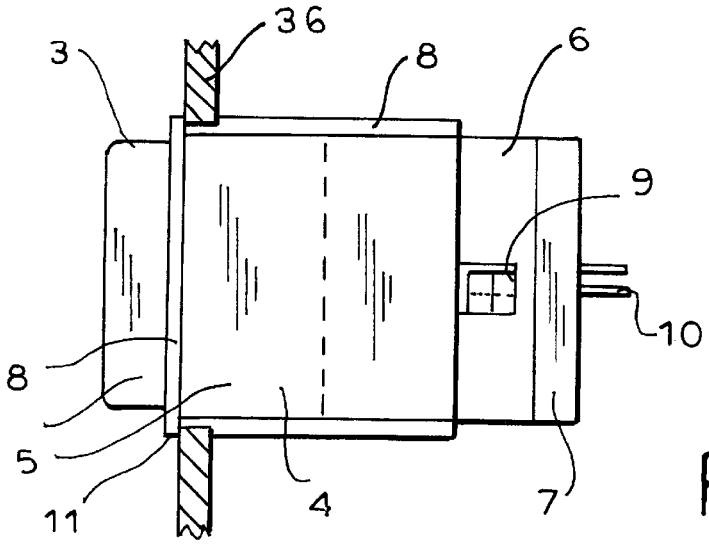
FIG. 1
FIG. 8
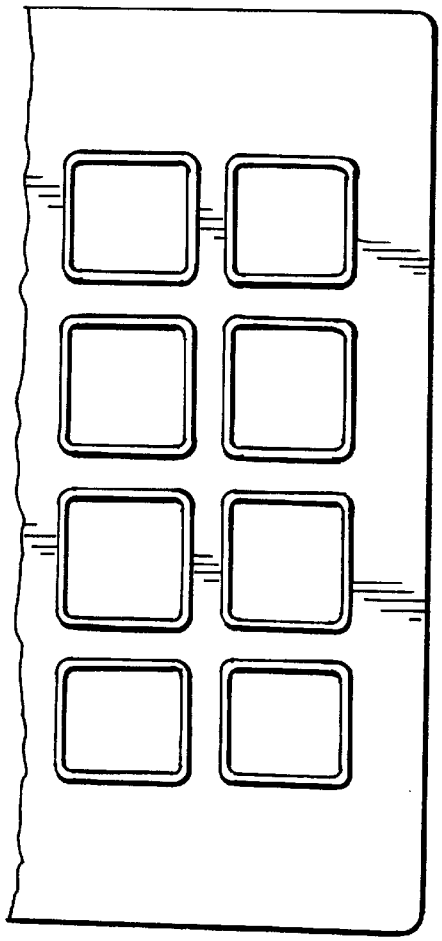
FIG. 2
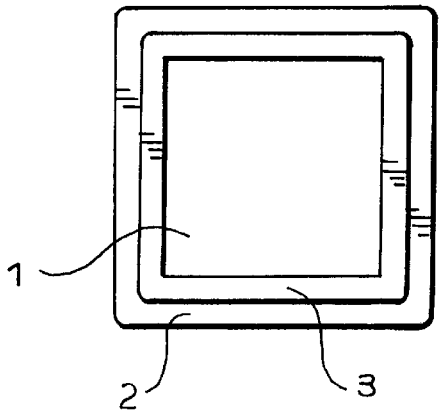

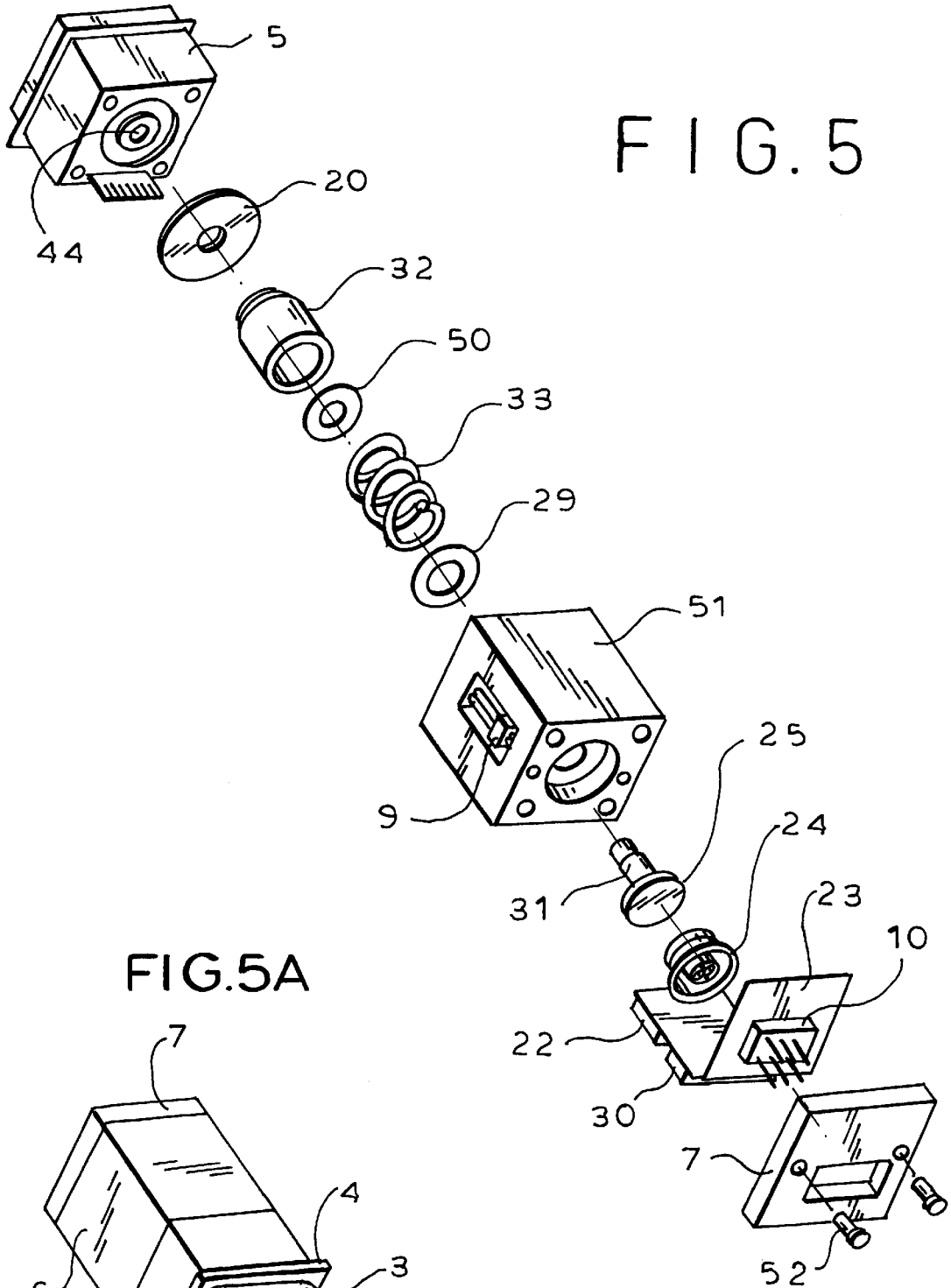
FIG. 5
FIG. 5A
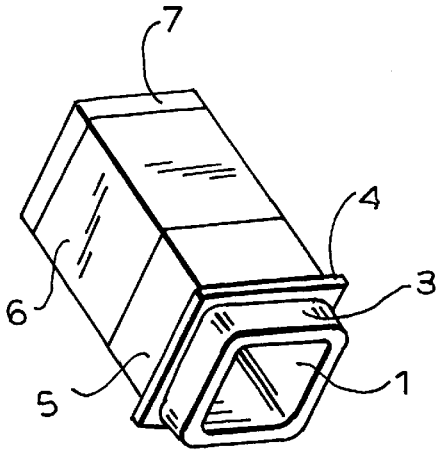

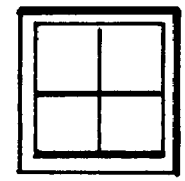
FIG.6A
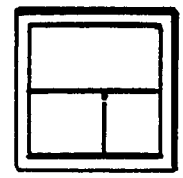
FIG.6C
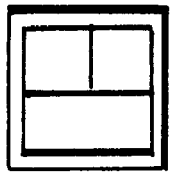
FIG.6E
FIG.6G
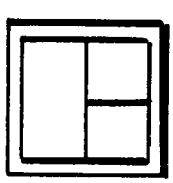
FIG.6B
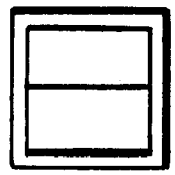
FIG.6D
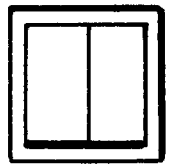
FIG.6F
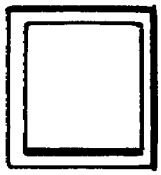
FIG.6H

ILLUMINATED PUSHBUTTON WITH COLORS AND BRIGHTNESS ELECTRONICALLY CONTROLLED

FIELD OF THE INVENTION

The invention relates to an illuminated pushbutton with variable color lights which are electronically controlled and wherein the light is emitted utilizing solid state devices.

More particularly the invention deals with a momentary action or alternate action switch realized without electromechanical commutation. ("Momentary action" means the generation of an electrical or electronic signal for the entire time the button is maintained active. "Alternate action" means the generation of an electrical or electronic signal which changes in state each time the pushbutton is pushed.) The pushbutton of the invention has an illuminated part consisting of a display which can be divided in independent zones, illuminated with visible light generated inside the button having a wavelength programmable independently for each zone. The zones can be of any number. The pushbutton described in the following is the version divided in four zones.

The invention is in the field of the electronic devices and is applicable to command/control illuminated pushbuttons for mechanical, electrical and electronic equipment. It can be used in the naval, avionic, space fields, and the pushbutton can support any stress even when the device s in operation.

The invention represents an advance in control pushbuttons. The display light is obtained by solid state components. The pushbutton configuration is such that the zones can be colored with any desired color, and these colors can be electrically changed depending on the user needs.

BACKGROUND OF THE INVENTION

The pushbuttons on the market to the best of our knowledge, are constituted by a switch and a display. The switch generally is mechanical and has a limited life because of the use of mechanical contacts and springs. Mechanical and electrical switching jumps are unwanted negative effects. Such effects generate false signals to be eliminated by electronic means.

Until now in such pushbutton, the part activated by the operator is illuminated by lamps which generate a base light similar to white light and to obtain different colors, filters and optical corrections are employed. These lamps do not permit changes in the emitted light color.

Operating rules and the human engineering prescriptions require the use of lighting of different colors and brightness. For instance, white light is used to permit the reading of information and the identification of the command by the operator; red light is used to read out alarm states and variable lighting (green, blue, amber, etc) can be used depending on the operative conditions.

Lamps have a limited useful life and require access into the illuminated pushbutton for the replacement of failed lamps.

To verify the presence of failed lamps it is necessary to implement a lamp test function that the operator activates using a specific command. The off state of the lamps, creates ambiguity between the condition of failed lamps or a deactivated state of a lamp.

SUMMARY OF THE INVENTION

The drawbacks described above are overcome by the illuminated pushbutton of the invention.

The pushbutton has a display made of solid sate components able to supply light, for instance LEDs, in the colors, red, green and blue. By mixing them any light color in the visible light spectrum can be generated without using filters. (Even the intensity can be electronically controlled).

The color switching and intensity are obtained electronically.

The pushbutton allows the activation of electric/electronic switching devices, for example conductive rubber switches, solid state switches, etc.

The pushbutton can be used to carry out millions of operations without incurring disadvantages caused by wear.

The MTBF values (Medium Time Between Failure) attainable are such to eliminate any need for maintenance work.

This illuminated pushbutton can also be employed in cockpits and in command and control panels in mechanical and electric and electronic equipment.

The display illumination is obtained by solid state components, through which it is possible to produce light of any color, even white. The display has unlimited working life by comparison with previous displays.

"Lamp tests" are not necessary.

The display is cold to the touch, even in maximum luminosity conditions.

The display is subdivided in zones and each zone can be illuminated independently both as to luminosity and to color.

The color of each zone can be dynamically varied in accordance with operational conditions. The possibility of change the color of the light, in a dynamic way, satisfied any rules prescribed. It is therefore possible to illuminate any zone with white light to facilitate the reading of legends and of the background, making it readable also in ambient sunlight.

A special switch actuator is employed which is able to control switches without mechanical contacts for instance, conductive rubber or solid state optical switches allowing unlimited numbers of operations even in severe shock and vibration conditions.

The pushbutton can be used in many configurations just by modifying the internal electronic circuits. For instance, by properly modifying the electronic circuitry alternate functions (bistable) of the electric contacts or direct control can be obtained through external commands of emitted light. The illuminated pushbutton can be used with many kinds of serial communications using several standard hardware and software protocols. The pushbutton can also include an internal microcontroller.

Another advantage of this invention is that the illuminated pushbuttons can be applied on panels, individually or in a matrix pattern. The matrix version offers compactness and reduction of the space, weight and cost and a better quality for a smaller number of parts utilized.

The input-output pushbutton connections are realized by direct coupling through motherboards or crimp connectors.

BRIEF DESCRIPTION OF THE DRAWING

The above and other objects, features, and advantages will become more readily apparent from the following description, reference being made to the accompanying drawing in which:

FIG. 1 is a side view of a pushbutton according to the invention;

FIG. 2 is top view of the pushbutton;

FIG. 5 is an exploded view of the pushbutton;

FIG. 5A is a perspective view thereof;

FIGS. 6A–6H are views showing various configurations of the display;

FIGS. 8 and 8A show the pushbutton assembly matrix configuration in an elevational and cross sectional view.

SPECIFIC DESCRIPTION

Figure 3:
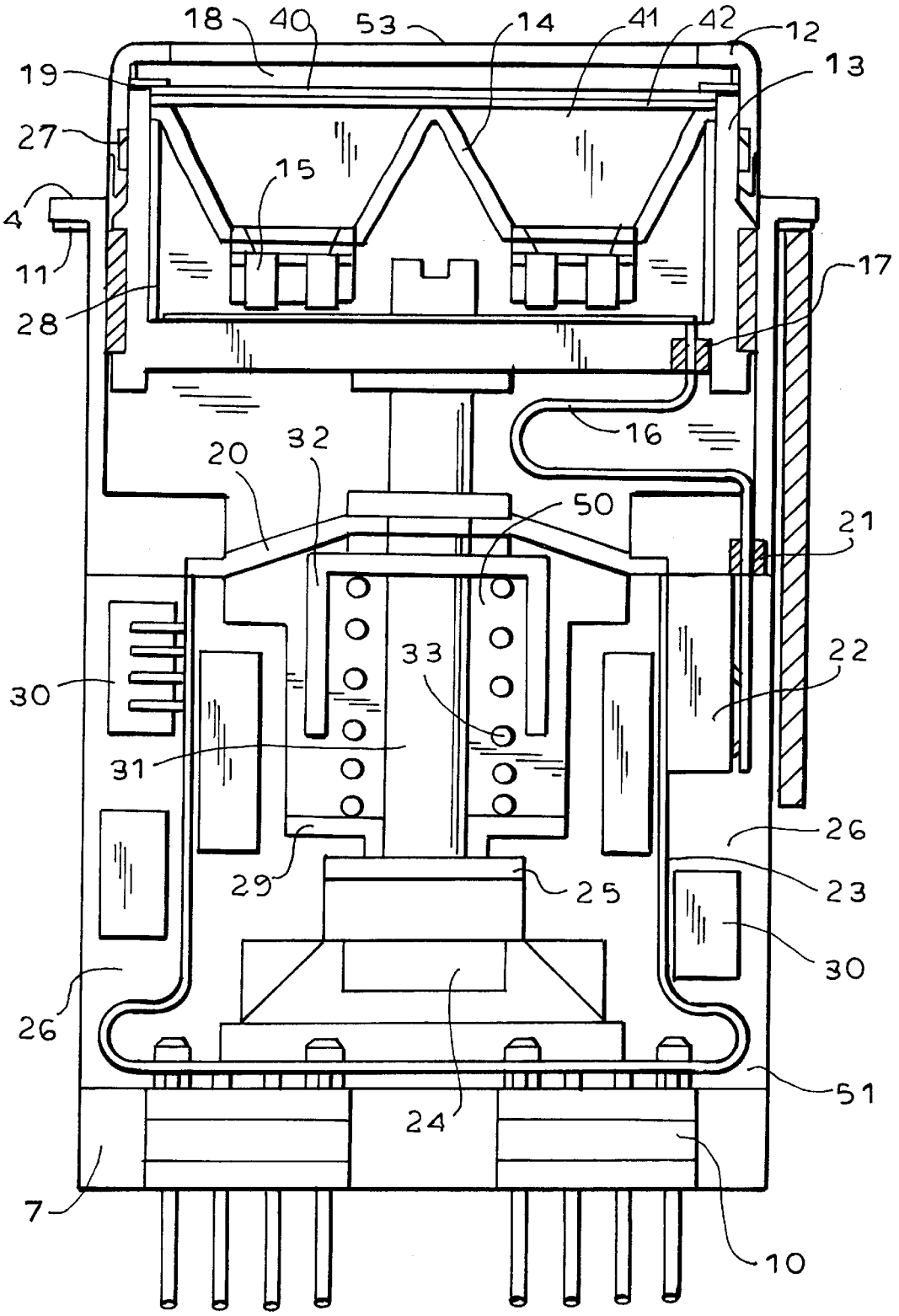
FIG. 3 is a section as seen from the side.

With reference to FIG. 1, the display assembly 5, constituted by a movable part 3 and a fixed part 4, includes the flange 2 for mounting in a panel 36 and is joined to the switch assembly 6 to constitute the pushbutton. The clamping spacer 8, clamped by the cam 9, is opposite to the flange 2 for clamping the pushbutton on the panel 36 by compression of the mounting gasket or seal 11. The pushbutton is closed on the rear side by a cover 7. Also the input-output connector 10 is on this side.

In FIG. 2, the illuminated area 1, the flange 2 and the movable part 3 of the display can be seen.

Figure 4:
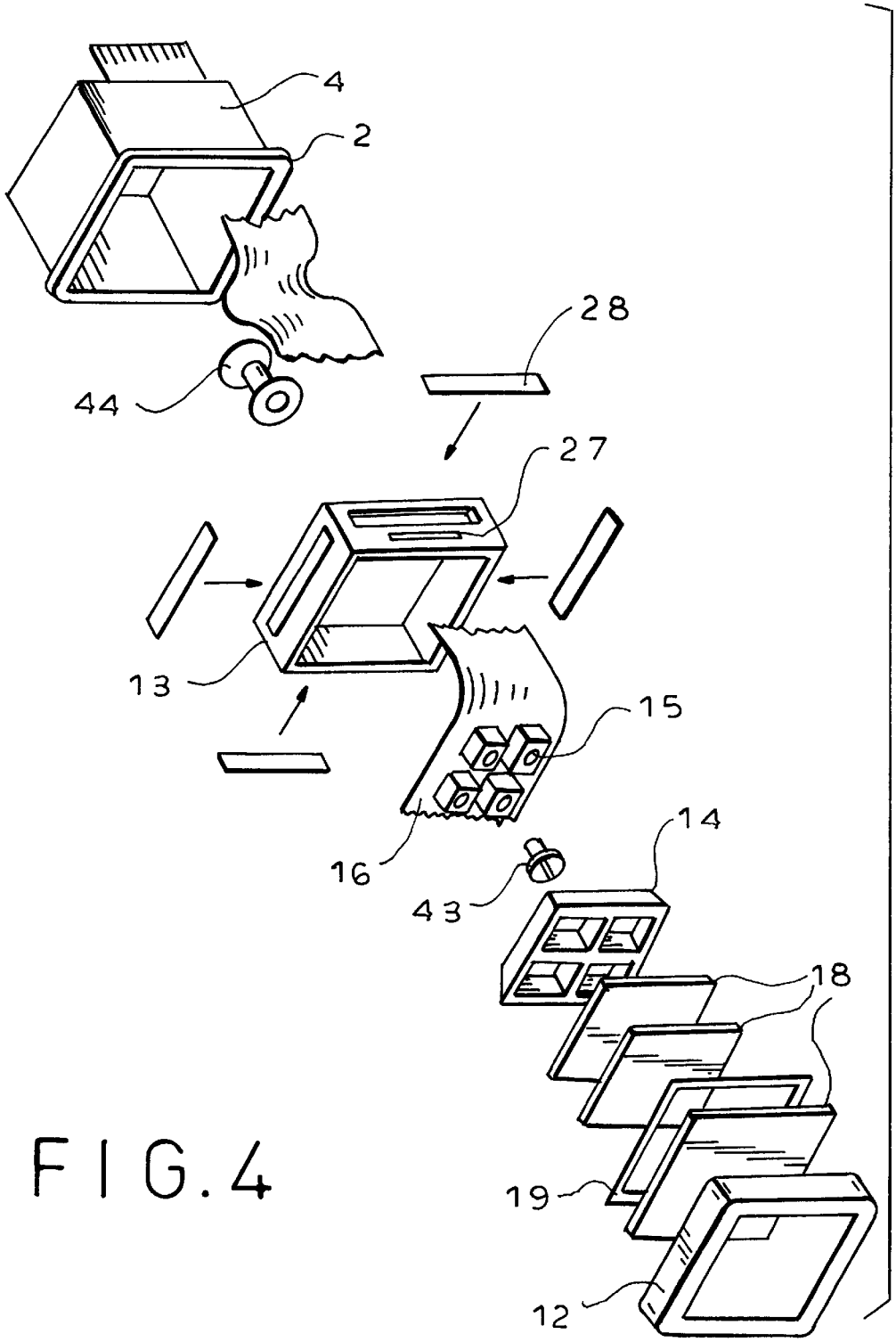
FIG. 4 is an exploded view of the display.

As can be seen from FIG. 3, the pushbutton comprises a display assembly of which an exploded view is seen in FIG. 4 having a display cover 12 which is mechanically connected to the display housing 13 by a mechanical latch 27. The display housing 13 encloses optical devices 18 are enclosed. These optical devices include transparent elements 40, a label 41, an optical diffuser 42 as may be necessary to obtain any optical performance required. The reflector 14 is utilized to direct the light emission of the solid state elements 15. The housing display 13 includes slide guide 28 which allows the movable element 3 of the display to shift along the actuator axis. The pushbutton gasket 20 (FIGS. 3 and 5) is employed to seal the pushbutton internal parts to avoid humidity or other contaminating elements in the switch zone 6 (FIGS. 1 and 5A). The mounting gasket 11 (which is not visible in FIG. 4) is mounted under the flange 2 to form a seal against external agents like water. The flexible circuit elements 16 is clamped by the screw 43 and sealed in the regions 17 and 21 to make the electrical connections between the display assembly (5) and the other parts of the pushbutton. The sealing out of the external agents at the front is obtained by the display gasket 19. The transmission of the movement in the pushbutton is effected by the actuator support 44.

The switch assembly 6 comprises the switch shell 51 (FIG. 5), the rear input-output cover 7, the spring guide 32, the actuator pin 31, the switch actuator 25, the spring 33 and the rubber switch 24. The movement along the vertical axis, effected by moving of the movable part 3 of the display, moves the switch actuator 25 and then presses the spring 33 housed in the spring guide 32 to activating the rubber switch 24 to give the switching function.

The vertical axis movement of the actuator is guided by the actuator slide guide 29. The actuator slide guide 29 and a washer 50 are of plastic to protect the metallic parts against damage by wear and abrasion.

The pushbutton electrical connections are realized by the flexible circuit 23 (FIG. 5) an the electronic components 30.

The connector 22 connects the display assembly with the switch. The electronic parts are housed in the zones 26 (FIG. 3). The electric connections of the pushbutton to the exterior are obtained by connector 10 mounted on the flexible circuit element 23.

FIGS. 6A–6H show some of the many configurations in which the display can be realized.

Figure 7:
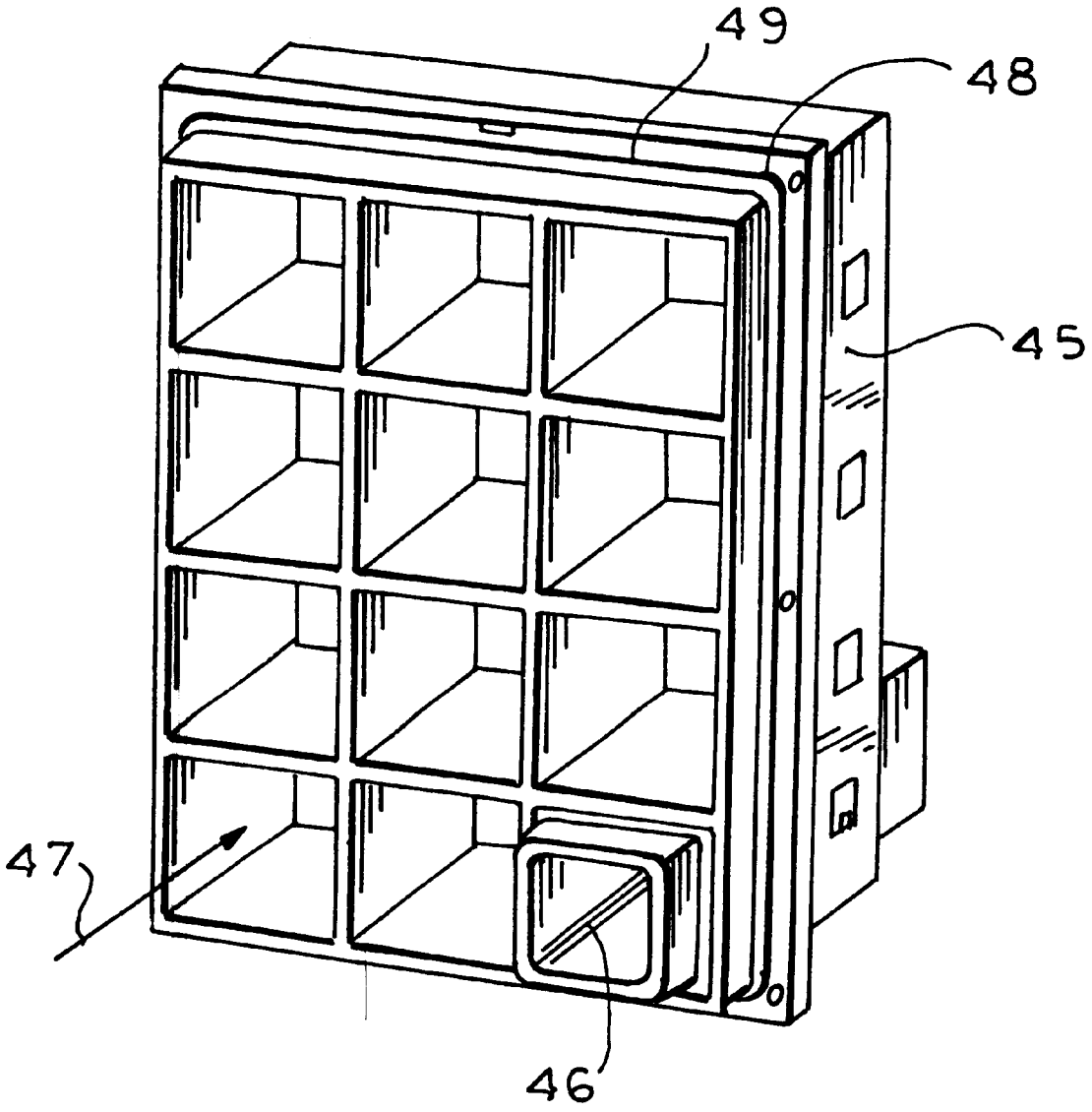
FIG. 7 is a perspective view of a pushbutton housing for matrix assembly.

FIG. 7 represents a matrix housing 45 for assembly of single pushbutton 46 in a matrix pattern.

The example shows a four-row three column matrix. It can thus contain twelve single pushbuttons. Each pushbutton inserts in the direction of the arrow 47 and when assembled, it reaches the position represented by the pushbutton 46. Even the flange 48 of this matrix has a gasket 49 to avoid contamination by external agents.

Figure 8A:
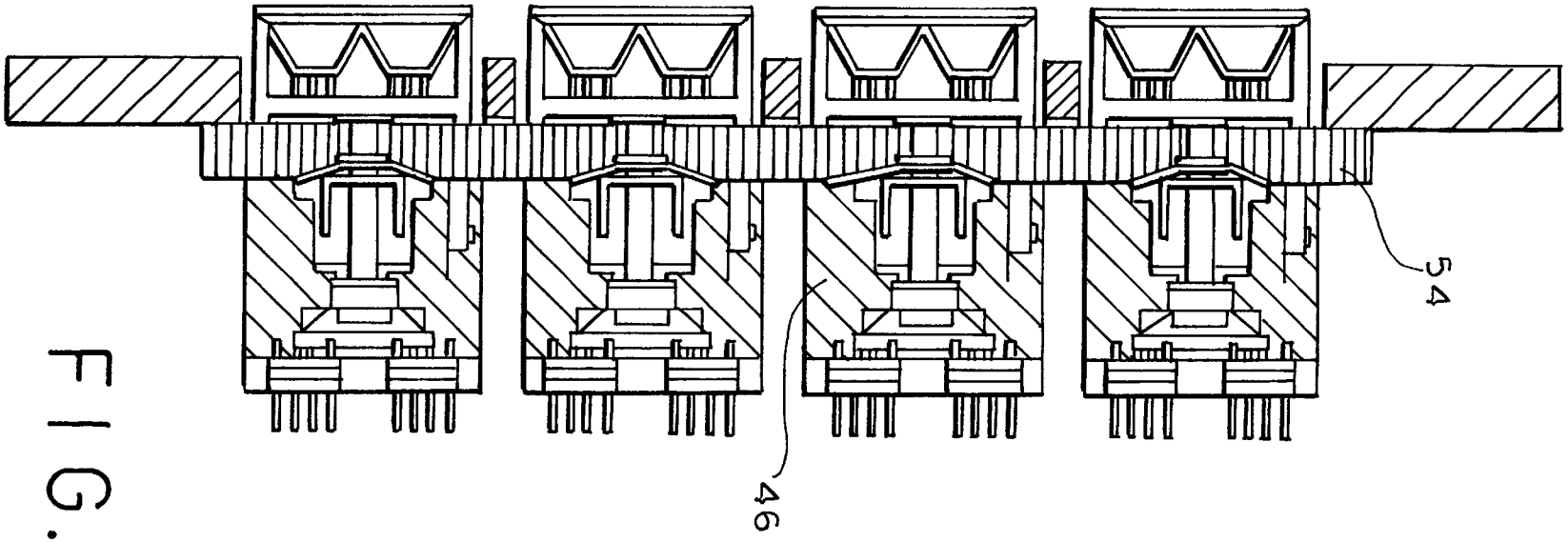

FIGS. 8 and 8A show a pushbutton matrix assembled during the manufacturing. It is a version with four rows and two columns, that is with eight illuminated pushbuttons.

In this case the fixed parts of the display 4, represented in FIG. 3, are substituted by a flange 54 on which the parts which constitute the pushbutton are assembled.

The pushbutton activation is effected by applying a proper pressure on the illuminated area 1. This action causes the shifting of the movable part 3 and then the movement on the axis of the switch actuator 25, the pressure on the switch 24 until the activation and then the generation of the signal electrical command. The travel of the display movable part is limited by a mechanical block between spring guide 32 and the actuator slide 29, while the spring 33 restores the initial position of the pushbutton when the pressure on the illuminated area 1 stops. The lighting is activated by electronic command applied through the connector 10, the flexible 24, electronic parts 30, connector 22, flexible circuit 16 to the solid state elements 15 which are LEDs or similar components.

What is claimed is:

1. An illuminated pushbutton comprising:

a fixed part having a flange adapted to be mounted on a panel;

a display assembly mounted on said fixed part and comprising:

a display support movable perpendicularly to said flange, a translucent display cover spanning said support and through which internal illumination of said pushbutton is visible, at least one solid-state variable color and variable intensity light-generating device on said support for producing illumination visible through said display cover with electronically controlled color and brightness, and optical means in said support transmitting said illumination from said devices to said cover and including at least one reflector, and an actuator support on said display support;

a connector for external connection on said fixed part spaced from said display assembly at an opposite end of said pushbutton from said display support;

electronic circuitry in said fixed part located between said connector and said display assembly for controlling illumination of said pushbutton and including circuitry for energizing said device to vary intensity and color of the illumination;

a flexible circuit element connecting said device to said electronic circuitry;

means for connecting said electronic circuitry to said connector;

a rear cover closing said fixed part at said opposite end, said connector extending through said rear cover;

a mechanical-wear-free switch supported by said rear cover and from a rubber switch and a solid-state optical switch;

a switch actuator acting upon said mechanical-wear-free switch;

an actuator pin extending along an actuation axis and transmitting motion of said actuator support to said switch actuator;

a spring guide surrounding said actuator pin and braced against said actuator support;

a spring surrounding said actuator pin and surrounded by said spring guide; and an actuator slide guide surrounding said pin and braced against said actuator, one of said guides being sleeve-shaped and axially engaging the other of said guides to limit displacement of said display support.

2. An illuminated pushbutton defined in claim 1 wherein said solid state linght-generating devices include solid state elements emitting light in three fundamental colors red green and blue, said optical means including a transparent element with a label and an optical diffuser.

3. An illuminated pushbutton defined in claim 1 wherein said mechanical-wear-free switch is a rubber switch.

4. An illuminated pushbutton defined in claim 3 further comprising a gasket between said flange and said panel.

5. An illuminated pushbutton defined in claim 3 further comprising a pushbutton gasket between said display and a housing containing said electronic circuitry, said flexible circuit element and said switch, said housing being closed by said rear cover.

6. An illuminated pushbutton defined in claim 1 wherein said electronic circuitry includes a microcontroller.

7. An illuminated pushbutton defined in claim 1 wherein said display cover is divided into zones and each of said zones is independently illuminatable by at least one of said solid state light generating devices.

* * * * *